US011359639B2

(12) United States Patent
Henning

(10) Patent No.: US 11,359,639 B2
(45) Date of Patent: Jun. 14, 2022

(54) WASTE WATER PUMP

(71) Applicant: GRUNDFOS HOLDING A/S, Bjerringbro (DK)

(72) Inventor: Poul Johannes Henning, Tjele (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 74 days.

(21) Appl. No.: 15/782,070

(22) Filed: Oct. 12, 2017

(65) Prior Publication Data

US 2018/0106264 A1 Apr. 19, 2018

(30) Foreign Application Priority Data

Oct. 14, 2016 (EP) ..... 16193892

(51) Int. Cl.
*F04D 29/08* (2006.01)
*F04D 7/04* (2006.01)
(Continued)

(52) U.S. Cl.
CPC ..... *F04D 29/086* (2013.01); *F04D 7/045* (2013.01); *F04D 29/165* (2013.01); *F04D 29/167* (2013.01); *F04D 29/2266* (2013.01); *F04D 29/4273* (2013.01); *F04D 29/4293* (2013.01); *F04D 11/005* (2013.01); *F05D 2250/51* (2013.01)

(58) Field of Classification Search
CPC ..... F04D 11/005; F04D 7/045; F04D 29/086; F04D 29/167; F04D 29/2288
See application file for complete search history.

(56) References Cited

U.S. PATENT DOCUMENTS 2,644,403 A * 7/1953 Dawson ..... F04D 7/045 415/121.1
4,118,856 A * 10/1978 Bainard ..... F16J 15/3244 264/295

(Continued)

FOREIGN PATENT DOCUMENTS

DE 522872 C 4/1931
EP 2 660 473 A1 11/2013

(Continued)

OTHER PUBLICATIONS

Sakurai, JP2005240629 Translation, 2005 (Year: 2005).*

*Primary Examiner* — Christopher Verdier
*Assistant Examiner* — Michael K. Reitz
(74) *Attorney, Agent, or Firm* — McGlew and Tuttle, P.C.

(57) ABSTRACT

A waste water pump includes an impeller (12) and a surrounding pump housing (4), wherein an impeller side chamber (20) is formed between the impeller (12) and the pump housing (4). The impeller side chamber (20) has a first seal (16) between the impeller (12) and the pump housing (4), towards the intake side (32) of the impeller (12), and a second seal (18) between the impeller (12) and the pump housing (4), towards the pressure side (14) of the impeller (12). The first seal (16) is provided with a conveying device (28, 30) configured to convey debris from the impeller side chamber (20) to the intake side (32) of the impeller (12). The second seal (18) is provided with conveying device (38, 40) configured to convey debris from the side chamber (20) to the pressure side (14) of the impeller (12).

17 Claims, 3 Drawing Sheets

(51) Int. Cl.

| | |
|---|---|
| ***F04D 29/16*** | (2006.01) |
| ***F04D 29/42*** | (2006.01) |
| ***F04D 29/22*** | (2006.01) |
| *F04D 11/00* | (2006.01) |

(56) References Cited

U.S. PATENT DOCUMENTS

| | | | | |
|---|---|---|---|---|
| 5,984,629 | A | 11/1999 | Brodersen et al. | |
| 6,726,213 | B2 * | 4/2004 | Wang | F16J 15/3412 277/400 |
| 7,429,160 | B2 * | 9/2008 | Roudnev | F04D 7/04 415/174.3 |
| 8,919,782 | B2 * | 12/2014 | Berdichevsky | F16J 15/3244 277/549 |
| 2013/0022450 | A1 | 1/2013 | Miyazaki et al. | |
| 2013/0294910 | A1 * | 11/2013 | Hansen | F04D 7/045 415/230 |
| 2014/0308142 | A1 * | 10/2014 | Andersson | F16J 15/44 417/423.11 |

FOREIGN PATENT DOCUMENTS

| | | | | |
|---|---|---|---|---|
| JP | 2005 240629 | A | | 9/2005 |
| JP | 2005240629 | A | * | 9/2005 |
| JP | 2005240764 | A | | 9/2005 |
| SU | 1413286 | A1 | | 7/1988 |

* cited by examiner

WASTE WATER PUMP

CROSS REFERENCE TO RELATED APPLICATIONS

This application claims the benefit of priority under 35 U.S.C. § 119 of European Application 16 193 892.3, filed Oct. 14, 2016, the entire contents of which are incorporated herein by reference.

FIELD OF THE INVENTION

The invention relates to a waste water pump with an impeller and a surrounding pump housing, wherein an impeller side chamber is formed between the impeller and the pump housing, the impeller side chamber having a first seal between the impeller and the pump housing towards the intake side of the impeller and a second seal between the impeller and the pump housing towards the pressure side of the impeller.

BACKGROUND OF THE INVENTION

For example EP 2 660 473 A1 discloses a waste water pump having a sealing configuration between intake and pressure side of the pump consisting of two sealings with an intermediate chamber or an impeller side chamber, respectively, therebetween. A first sealing (sealing configuration/seal) is placed closed to the suction port of the impeller, whereas the second sealing (sealing configuration/seal) is provided distanced to the first sealing on the opposite side of the impeller side chamber towards the outlet or pressure side of the impeller. In such sealing configuration there is the problem that debris like particles or fibers may clog inside the impeller side chamber.

SUMMARY OF THE INVENTION

It is the object of the invention to improve a waste water pump having a sealing configuration with an impeller side chamber such that a clogging of debris inside the impeller side chamber can be avoided.

The waste water pump according to the invention comprises an impeller and a surrounding pump housing. The impeller is rotatable inside the pump housing. The pump housing defines an intake port or intake channel (intake side) and an outlet channel, wherein the intake channel ends in the intake port of the impeller and the outlet channel is extending away from the pressure or outlet side of the impeller. The outlet channel forms a spiral channel surrounding the impeller. There is a sealing configuration having an impeller side chamber between the intake side and the outlet channel, i.e. the suction side and the outlet or pressure side of the impeller. The impeller side chamber or intermediate chamber is formed between a wall of the surrounding pump housing and a circumferential wall of the impeller. The impeller side chamber has a first sealing (first sealing configuration/first seal) between the impeller and the pump housing towards or adjacent to the intake side of the impeller and a second sealing (second sealing configuration/second seal) between the impeller and the pump housing towards or adjacent the pressure side of the impeller. The first and second seals are distanced in axial direction along the rotational axis of the impeller. The impeller side chamber is defined between these two seals.

Furthermore, the impeller preferably is connected with a drive motor via a drive shaft connected with the impeller or unitarily formed with the impeller. The drive motor may be an electric drive motor connected to the waste water pump via a suitable coupling or may be an integrated electric drive motor of the waste water pump according to the invention.

According to the invention the first sealing is provided with conveying means which are configured such that they convey debris from the impeller side chamber into the intake side of the impeller. This means the conveying means is configured such that it conveys debris which may have entered the impeller side chamber out of the impeller side chamber into the intake side of the impeller, i.e. the intake port or intake channel. There the debris will move together with the pumped fluid through the impeller towards the pressure or outlet channel. According to the invention also the second sealing is provided with conveying means which is configured such that it conveys debris from the side chamber towards the pressure side of the impeller. This means the conveying means in the second sealing is configured or formed respectively, such that debris or particles which have entered the impeller side chamber are conveyed out of the impeller side chamber into the pressure side of the pump, i.e. the spiral channel surrounding the impeller. Subsequently, the particles or debris are moved out of the pump housing by the fluid flowing through the pressure or outlet channel. Thus, according to the invention in both of the sealings on two opposite axial end sides of the impeller side chamber conveying means are provided, whereas the conveying means are acting in opposite directions such that debris or particles can be removed through both of the sealings out of the impeller side chamber into the adjacent fluid channels, either the intake side adjacent to the first sealing or the pressure side adjacent to the second sealing. By this design an improved removal of debris from the impeller side chamber can be achieved and a clogging of debris inside the impeller side chamber can be avoided.

The conveying means may be configured in different ways. The conveying means preferably are driven or actuated by the rotation of the impeller. Preferably the conveying means are configured as guiding means guiding particles or debris through the sealing out of the impeller side chamber in the respective direction defined above. By movement of at least a part of the guiding means by rotating the impeller a force in a direction transverse to the rotation can be applied to particles and/or debris such that they are moved by the conveying or guiding means through the sealing out of the impeller side chamber. According to a further preferred embodiment the guiding means may be configured as an inclined guidance. Such inclined guidance may be moved together with the impeller in rotational direction and thereby applying a force transverse to the rotation onto particles to be moved through the sealing. Preferably the guidance is angled relative to a circumferential line around the rotational axis of the impeller in an acute angle, preferably smaller than 12°.

According to a preferred embodiment the second sealing is formed by a first annular sealing surface and a facing second annular sealing surface, said first sealing surface having a helical groove as conveying means. The helical groove acts as a guidance guiding particles or debris through the sealing in a transverse direction by rotation of the impeller. Thereby debris or particles are moved across the sealing when in contact with the helical groove. The respective movement may be produced either by rotation of the helical groove together with the impeller or a rotational movement of the debris. A rotational movement of debris can be caused by friction or a fluid flow in the respective direction caused by the rotation of the impeller. According to a first preferred embodiment the first annular sealing surface having the helical groove is arranged on the pump housing and facing towards the impeller. In an alternative embodiment this first annular sealing surface may be arranged on the impeller and facing outward towards the surrounding pump housing. Accordingly, the second annular sealing surface may either be arranged on the impeller or in case that the first annular sealing surface is arranged on the impeller being arranged on the surrounding pump housing.

Preferably said second annular sealing surface has at least one cut out at one circumferential position and/or at least one helical groove. Such a cut our preferably extends across the entire sealing, i.e. from the side chamber to the spiral channel surrounding the outlet side of the impeller. Such a cut out allows a fluid flow across the sealing from the side chamber towards the pressure or outlet side of the impeller. Alternatively, the cut out may only extend partially across the sealing. Furthermore, the cut out or recess, respectively, might act as a means for fragmenting solid matter like debris or particles or fibers. By way of this, one succeeds in solid matter or fibers firstly being reduced in size when moved through the sealing towards the pressure side of the impeller, i.e. the spiral channel or chamber surrounding the pressure side of the impeller. Preferably the recess has the shape of a half cylinder, in particular a half circular cylinder. Alternatively or in addition the second annular sealing surface may be provided with at least one helical groove. Generally this helical groove may be configured as the helical groove on the first annular sealing surface described above. Preferably the helical groove on the second annular sealing surface is twist in opposite direction compared to the helical groove on the first annular sealing surface. Since the two helical grooves on the two facing annular sealing surfaces are moved relatively to one another by rotation of the impeller debris like fibers may be conveyed or guided through the sealing from the impeller side chamber towards the pressure side of the impeller.

The at least one cut out preferably extends across the second annular sealing surface transverse to the circumferential direction, in particular normal to the rotational direction. According to an alternative embodiment the cut out may be slant or inclined to the rotational axis instead of extending parallel to the rotational axis. In particular, the cut out optionally may be inclined in rotational direction. The cut out preferably may extend across the entire sealing surface such that it connects both sides of the sealing as described above. Alternatively, the cut out may extend only partially across the sealing.

Furthermore, depending on the design of the surfaces of the second sealing the cut out may extend across the second annular sealing surface in a direction parallel and/or radial to the rotational axis of the impeller. In case the second annular sealing surface extends parallel to the rotational axis also the cut out preferably extends in a direction parallel to the rotational axis. In case that the second annular sealing surface should extend in a direction transverse, preferably right angled to the rotational axis the cut out may extend in radial direction across the sealing surface. Furthermore, it would also be possible to design the second sealing such that the sealing surfaces extend inclined to the rotational axis in an angle between 0 and 90°. Then the sealing surface extends in a direction having a component in axial direction and a component in radial direction, i.e. parallel and radial to the rotational axis of the impeller.

Further preferred the second annular sealing surface is a smooth surface except the at least one cut out. The smooth surface ensures good sealing properties since gaps inside the sealing are reduced. Furthermore, the movement of debris to be conveyed through the sealing is enhanced since the cut out may act as a driver or drive means moving debris along the facing helical groove in the facing annular sealing surface.

According to a further preferred embodiment the impeller has at least one radial protrusion between the first and the second sealing, i.e. inside the impeller side chamber, wherein preferably said at least one cut out is disposed on the impeller at a position in front of said protrusion in the rotational direction of the impeller. The protrusion forms an asymmetric protrusion on the impeller surface providing an increased pressure wave and thereby a flow through the mentioned cut out from the intermediate chamber or impeller side chamber, respectively, into the pressure chamber or spiral channel surrounding the impeller. Hereby, even more debris and solid material can be removed from the impeller side chamber and away from the helical groove into the pressure chamber or spiral chamber, respectively.

The aforementioned protrusion preferably acts as a counter-weight for balancing the impeller. Thereby, the protrusion can have two effects, namely balancing the impeller and providing a pressure wave inside the impeller side chamber.

According to a further preferred embodiment of the invention the helical groove in the first annular sealing surface of the second sealing twists in the rotational direction of the impeller such that the groove ascends toward the pressure side of the impeller. This design is preferred if the first annular sealing surface comprising the helical groove is arranged on the pump housing. In case that the first annular sealing surface comprising the helical groove should be arranged on the impeller it may be preferred that the helical groove twists in opposite direction, i.e. such that the groove ascends toward the impeller side chamber in the rotational direction of the impeller. This inclination of the helical groove ensures that debris like fibers or particles are moved along the helical groove towards the pressure chamber surrounding the impeller.

Furthermore, the present invention also refers to the design of the first sealing between the impeller and the surrounding pump housing, i.e. the sealing adjacent to the suction side of the impeller, preferably surrounding the suction port of the impeller. The design of this first sealing as described in the following may be used in connection with the design of the second sealing as described above. Nevertheless, the design of the first sealing as described in the following may also be used independently from the aforementioned design of the second sealing. Furthermore, the design of the first sealing may also be used for a single sealing, i.e. a sealing between impeller and surrounding pump housing without an intermediate chamber, i.e. without a second sealing.

Preferably the first sealing is formed by a first annular sealing surface on the impeller and a facing or opposing second annular sealing surface on the pump housing. Preferably the first and the second annular sealing surfaces of this first sealing each have a helical groove. These helical grooves act as guides—guidance means—guiding or conveying debris out of the impeller side chamber into the suctions side of the impeller. Also, in this first sealing, the movement or conveyance of the debris is achieved by a relative movement of the two helical grooves when rotating the impeller. This mechanism is the same as described with reference to the second sealing.

Preferably the two helical grooves on the first and the second sealing surface of the first sealing twist in opposite directions. This results in an improved movement of debris like particles or fibers across the sealing towards the suction side of the impeller.

According to a further preferred embodiment the helical groove on the second annular sealing surface of said first sealing twists in the rotational direction of the impeller such that the groove ascends toward the suction side of the impeller. By this particles or fibers guided along the helical groove are moved from the impeller side chamber into the suction channel on the suction side of the impeller.

As already described above with reference to the second sealing the sealing surfaces of said first sealing and/or said second sealing may extend in a direction parallel or inclined to the rotational axis of the impeller. Thereby, the surfaces may be inclined in an angle between 0 and 90° relative to the rotational axis of the impeller.

The invention is hereinafter described by way of example and with reference to the attached figures.

The present invention will be described in detail below with reference to the figures attached. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
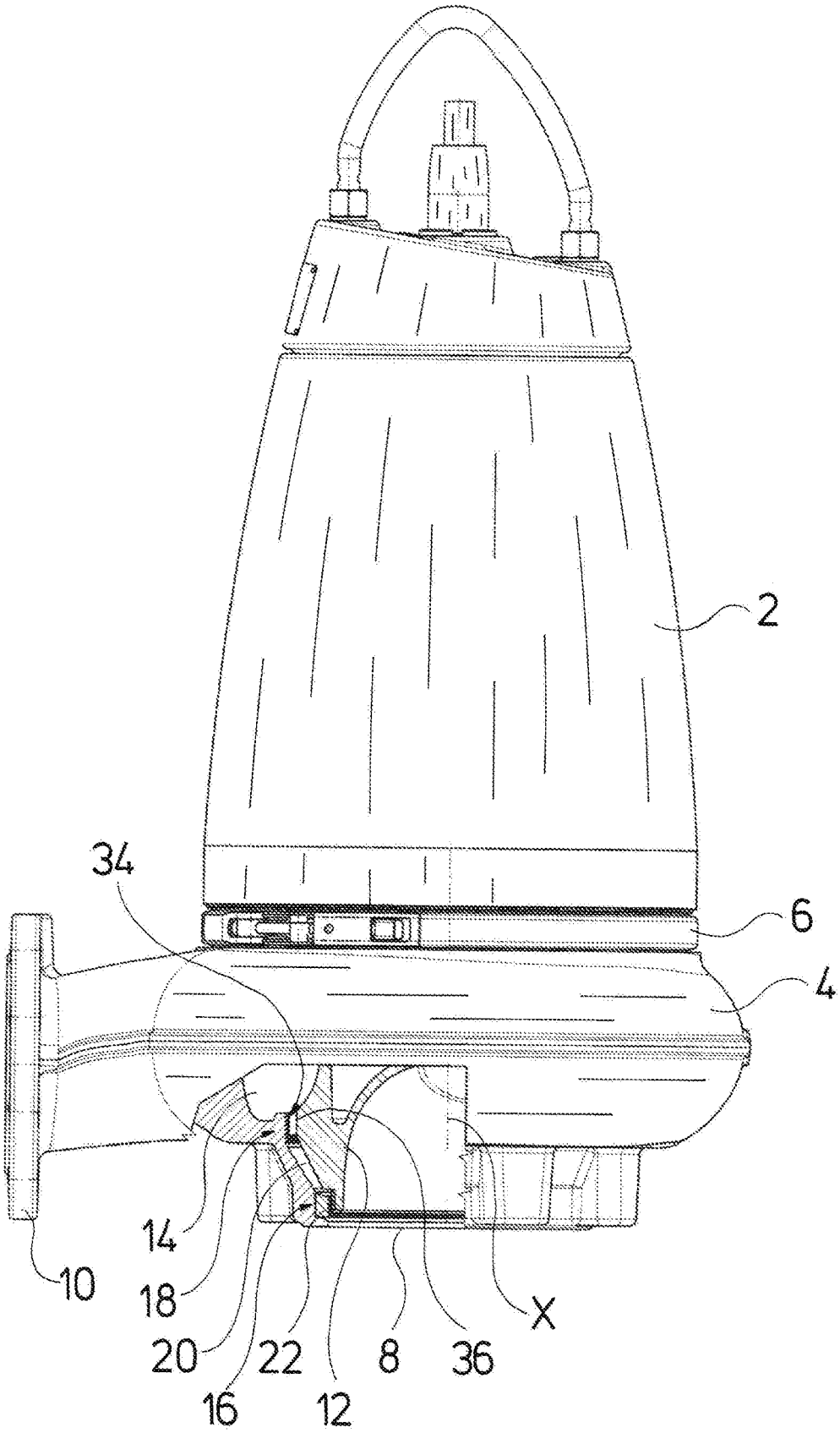
FIG. 1 is a partly sectioned entire view of a waste water pump according to the invention, in the form of a submersible pump assembly.
Figure 2:
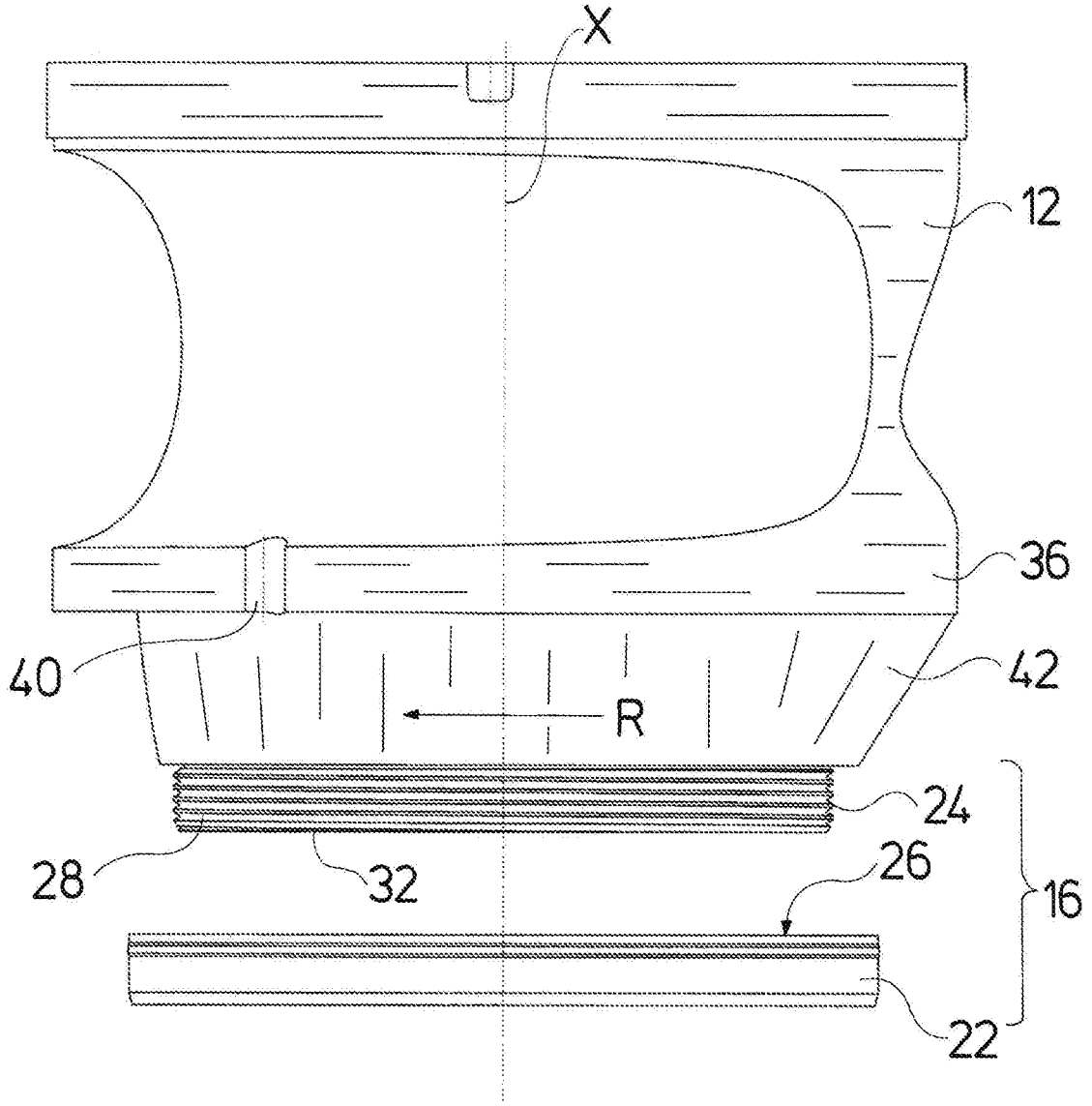
FIG. 2 is a detailed view of the impeller and a sealing ring of a first sealing of the pump according to FIG. 1.
Figure 3:
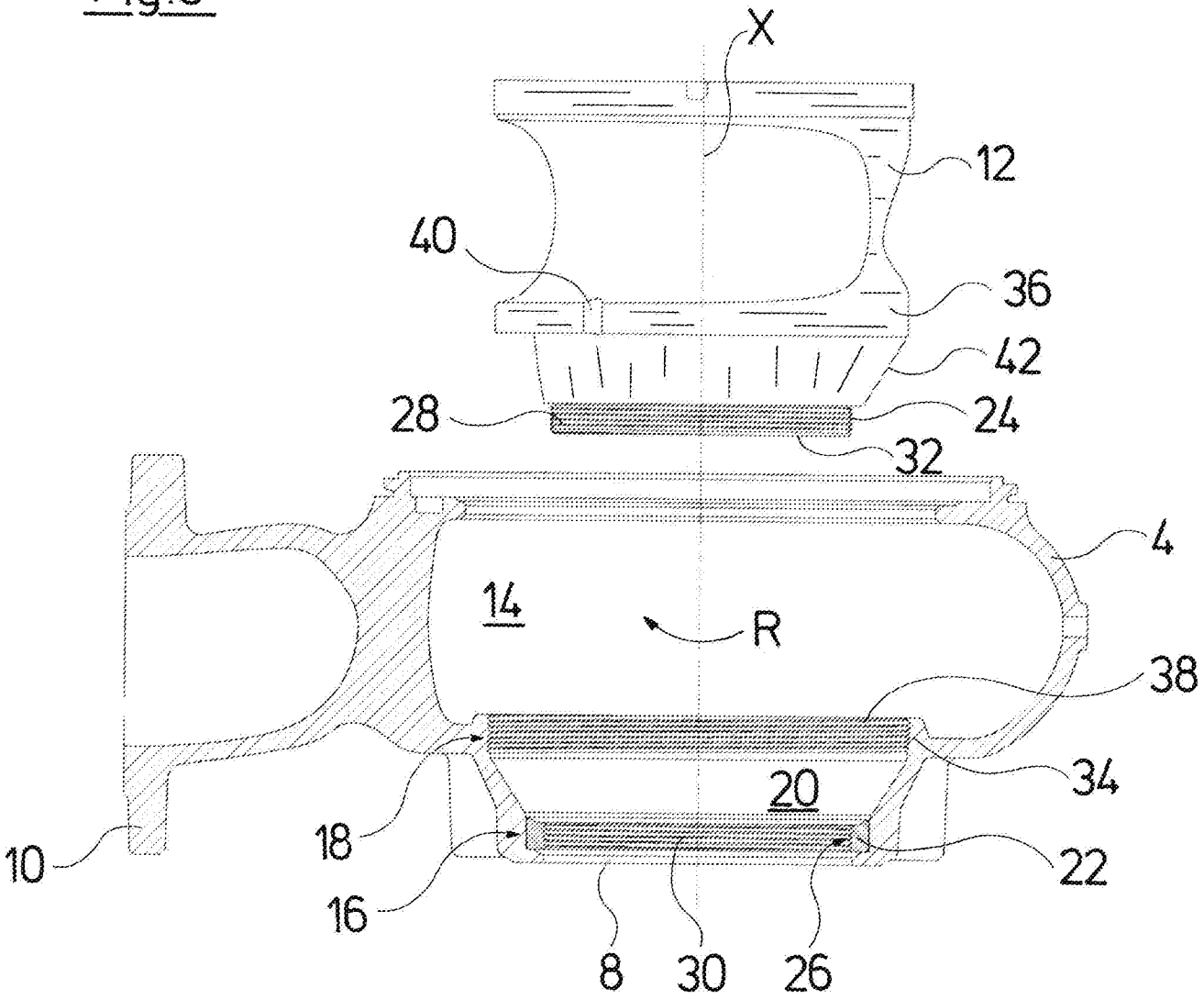
FIG. 3 is a cross section of the pump housing of the pump according to FIG. 1 with the impeller removed from the pump housing.

Referring to the drawings, the shown waste water pump is configured as a submersible pump assembly with an electric drive motor 2 and with a pump housing 4 connected to the electric drive motor. In this example the pump housing 4 is arranged on the lower end of the drive motor 2 and connected to the electric drive motor 2 by a clamping ring 6. The pump housing 4 on its lower side is provided with a central opening 8 which forms the intake opening or the suction port of the pump assembly. A pressure connection 10 on which an outlet conduit may be connected extends in the lateral direction, radially to the rotational axis X. An impeller 12 is arranged in the inside of the pump housing 4 which is configured as a spiral housing surrounding the impeller. In this case the impeller 12 is configured as a single-channel impeller. However, a different design of the impeller may be possible. Inside the pump housing 4 there is a spiral chamber 14 surrounding the pressure side of the impeller 12 and connected to the pressure connection 10. The spiral chamber 14 forms a pressure channel or pressure space inside the pump housing 4.

Between the central opening 8 forming the intake port or intake side of the pump assembly and the spiral chamber 14 there is arranged a sealing assembly between the pump housing 4 and the impeller 12. This sealing assembly consists of two sealings spaced from one another. A first sealing 16 is arranged close to the intake side of the impeller, i.e. the central opening 8 of the pump housing 4. The second sealing 18 is arranged adjacent to the spiral chamber 14. Between the first sealing 16 and the second sealing 18 there is provided an impeller side chamber 20 or intermediate chamber, respectively. The impeller side chamber 20 is a free space between the outer circumference of the impeller 12 and the surrounding wall of the pump housing 4.

In this example the first sealing 16 is a lower sealing. This sealing is formed by a sealing ring 22 fixed inside the pump housing 4 surrounding the central opening 8. The first sealing 16 is formed by a first annular sealing surface 24 formed on the outer circumference of the impeller 12 concentric to the rotational axis X and a second annular sealing surface 26 provided on the inner circumference of the sealing ring 22. When the impeller 12 is inserted into the pump housing 4 as shown in FIG. 1 the first annular sealing surface 24 on the impeller 12 is facing the second annular sealing surface 26 inside the sealing ring 22. The first annular sealing surface 24 is provided with a first helical groove 28 winding or twisting around the rotational axis X. The second annular sealing surface 26 is provided with a second helical groove 30 also winding or twisting around the rotational axis X. The helical grooves 28 and 30 are arranged such that they do not engage with one another but that the outer circumference of the first annular sealing surface is in contact with the inner circumferential surface of the second annular sealing surface 26 or distanced by a sealing gap. This means, preferably the crests of the two facing threads formed by the first helical groove 28 and the second helical groove 30 are in contact with one another or spaced by the sealing gap. The first helical groove 28 and the second helical groove 30 in this example have the same pitch, but are inclined in opposite directions. This means the first helical groove and the second helical groove are wound or twisted in opposite directions around the rotational axis X. The second helical groove 30 forming the outer helical groove twists in the rotational direction R of the impeller such that the grooves extend ascends toward the suction side of the impeller, i.e. the central opening 8. Accordingly, the first helical groove 28 on the first annular sealing surface 24 is wound such that the groove ascends away from the suction side 32 of the impeller.

The design of the first sealing 26 as described forgoing may also be used as a single sealing independent from a second sealing 18 as described in the following.

The second sealing 18 consists of a first annular sealing surface 34 formed in an opening of the pump housing 4 surrounding the impeller 12 and a facing second annular sealing surface 36 provided on the outer circumference of the impeller 12. The first annular sealing surface 34 is provided with a helical groove 38 similar to the helical groove 30 provided in the sealing ring 22. However, the helical groove 38 is wound in opposite direction such that it in the rotational direction R of the impeller 12 ascends toward the pressure side, i.e. the spiral chamber 14. When the impeller 12 is inserted into the pump housing 4 as shown in FIG. 1 the second annular sealing surface 36 is facing the first annular sealing surface 34. Thereby, the crests of the thread formed by the helical groove 38 preferably are in contact with the second annular sealing surface 36. The second annular sealing surface 36 in this embodiment is formed as a smooth surface with one cut out 40. The cut out 40 traverses the sealing surface 36 normal to the circumferential direction, i.e. parallel to the rotational axis X. Thereby, the cut out 40 connects the impeller side chamber 20 with the spiral chamber 14.

In the region of the impeller 12 forming the inner wall of the impeller side chamber 20 there is provided a protrusion 42 acting as a counterweight for balancing the impeller. When the impeller 12 is rotating inside the pump housing 4 this protrusion 42 produces a pressure wave inside the impeller side chamber 20. Since the cut out 40 is arranged in front of the protrusion 42 (seen in the rotational direction R) the pressure wave causes a fluid flow through the cut out from the impeller side chamber 20 towards the spiral chamber 14.

When the impeller 12 is rotating inside the pump housing the described helical grooves act as conveying means conveying debris like particles or fibers out of the impeller side chamber. Because of the opposite twisting of the two helical grooves 30 and 38 in the first sealing 16 and the second sealing 18 debris is conveyed through the first sealing 16 toward the suction side, i.e. towards the central opening 8 and the suction side 32 of the impeller 12. In the second sealing 18 debris is conveyed in the opposite direction towards the spiral chamber 14. The conveying of fibers or debris in a direction transverse to the rotational direction R is caused by the first helical groove 28 on the first sealing surface 24 of the first sealing 16 and the cut out 40 in the second annular sealing surface 36 of the second sealing 18. These elements act as drivers or driving means moving particles or fibers entering the respective sealing in rotational direction. When those fibers or particles come into contact with the outer helical grooves 30 and 38 inside the outer sealing surfaces they are moved along the helical grooves 30 and 38 through the respective sealing 16, 18 out of the impeller side chamber 20. At the same time in particular the cut out 40 may act as means for fragmenting those solid matters to be conveyed through the sealing.

While specific embodiments of the invention have been shown and described in detail to illustrate the application of the principles of the invention, it will be understood that the invention may be embodied otherwise without departing from such principles.

List of reference designations:

electric drive motor
pump housing
clamping ring
central opening
pressure connection
impeller
spiral chamber
first seal
second seal
impeller side chamber, intermediate chamber
seal ring
first annular seal surface
second annular seal surface
first helical groove
second helical groove
suction side
first annular seal surface
second annular seal surface
helical groove
cut out
protrusion, counterweight
rotational axis

What is claimed is:

1. A waste water pump comprising: an impeller; a pump housing surrounding the impeller, wherein an impeller side chamber is formed between the impeller and the pump housing; a first seal, said impeller side chamber having the first seal between the impeller and the pump housing towards an intake side of the impeller; and a second seal, at least a portion of the second seal being arranged adjacent to a pressure side of the impeller, said impeller side chamber having the second seal between the impeller and the pump housing towards the pressure side of the impeller, wherein the first seal is provided with a first seal conveying means configured to convey debris and the second seal is provided with a second seal conveying means configured to convey debris, the first seal comprising a first annular sealing surface on the impeller and a facing second annular sealing surface on the pump housing, wherein the first annular sealing surface and the facing second annular sealing surface of the first seal each have a groove, the impeller side chamber being formed between a wall of the surrounding pump housing and an outer circumferential wall of the impeller, the first seal and the second seal being located at a spaced location from each other in an axial direction, wherein the impeller side chamber is defined between the first seal and the second seal, the second seal comprising a first annular sealing surface and a facing second annular sealing surface, said first annular sealing surface of the second seal having a groove as the second seal conveying means, wherein said facing second annular sealing surface of the second seal has at least one cut out at one circumferential position and/or at least one groove, the second seal being arranged between the pressure side of the impeller and the impeller side chamber.

2. The waste water pump according to claim 1, wherein: the first annular sealing surface of the second seal is disposed on the pump housing; and the facing second annular sealing surface of the second seal is defined by an outer peripheral surface of the impeller.

3. The waste water pump according to claim 1, wherein the at least one cut out extends across the facing second annular sealing surface of the second seal transverse to a circumferential direction, the pump housing comprising a pump housing chamber surrounding at least a portion of the pressure side of the impeller, at least a portion of the second seal being arranged adjacent to the pump housing chamber.

4. The waste water pump according to claim 1, wherein the at least one cut out extends across the facing second annular sealing surface of the second seal parallel and/or radial to a rotational axis of the impeller.

5. The waste water pump according to claim 1, wherein the facing second annular sealing surface of the second seal is a smooth surface except for the at least one cut out, the pump housing comprising a pump housing chamber surrounding the pressure side of the impeller, the second seal being arranged between the pump housing chamber and the impeller side chamber.

6. The waste water pump according to claim 1, wherein: the impeller has at least one radial protrusion between the first and the second seal; and said at least one cut out is disposed on the impeller at a position in front of said at least one radial protrusion in a rotational direction of the impeller.

7. The waste water pump according to claim 6, wherein said at least one radial protrusion is a counterweight for balancing the impeller.

8. The waste water pump according to claim 1, wherein the groove in the first annular sealing surface of the second seal twists in a rotational direction of the impeller such that the groove ascends toward the pressure side of the impeller.

9. The waste water pump according to claim 1, wherein the groove on the facing second annular sealing surface of the second seal extends in a rotational direction of the impeller such that the groove on the facing second annular sealing surface ascends toward the suction side of the impeller.

10. The waste water pump according to claim 1, wherein: the-first annular sealing surface of the first seal is on the impeller and extending in a direction parallel to or inclined to a rotational axis of the impeller and the facing second annular sealing surface of the first seal is on the pump housing and extending in a direction parallel to or inclined to the rotational axis of the impeller; and the first annular sealing surface of the second seal is extending in a direction parallel to or inclined to the rotational axis of the impeller and the facing second annular sealing surface of the second seal is extending in a direction parallel to or inclined to the rotational axis of the impeller.

11. A waste water pump comprising: an impeller; a pump housing surrounding the impeller; a first seal structure arranged between a first area of the impeller and a first area of the pump housing, the first area of the impeller comprising a first impeller outer annular surface, the first seal structure comprising the first impeller outer annular surface and another first seal structure annular sealing surface comprising a housing surface of the pump housing, the housing surface being located opposite the first impeller outer annular surface, wherein the first impeller outer annular surface defines a first groove in the first area of the impeller and the housing surface defines a second groove adjacent to the first area of the pump housing, and a second seal structure arranged between a second area of the impeller and a second area of the pump housing, the first seal structure, the second seal structure, a circumferential wall of the impeller and a wall of the pump housing defining an impeller side chamber, wherein the impeller side chamber is located between the pump housing and the impeller and the impeller side chamber is located axially between the first seal structure and the second seal structure with respect to a longitudinal axis of the impeller, wherein the first seal structure comprises a first seal conveying means for conveying debris from the impeller side chamber, the second seal structure comprising a second seal conveying means for conveying debris from the impeller side chamber, at least a portion of the second seal structure being located adjacent to the pressure side of the impeller, wherein the first seal conveying means and the second seal conveying means are configured to cooperate to move debris out of the impeller side chamber via actuation of the impeller; wherein the second seal structure comprises a pump housing inner annular surface in the second area of the pump housing and a second impeller outer peripheral annular surface in the second area of the impeller, the pump housing inner annular surface defining a third groove, the pump housing comprising a pump housing chamber surrounding the pressure side of the impeller, the second seal structure being arranged between the pump housing chamber and the impeller side chamber.

12. The waste water pump according to claim 11, wherein the first impeller area is located radially opposite the first pump area with respect to a longitudinal axis of the pump housing, the second impeller area being located radially opposite the second pump area with respect to the longitudinal axis, the first pump area being located at an axially spaced location from the second pump area with respect to the longitudinal axis, the first impeller area being located at an axially spaced location from the second impeller area with respect to the longitudinal axis.

13. A waste water pump comprising: an impeller comprising a first impeller outer annular portion defining a first groove, the impeller further comprising a second impeller outer annular portion and a third impeller outer annular portion, the third impeller outer annular portion being located between the first impeller outer annular portion and the second impeller outer annular portion; a sealing structure comprising a sealing structure first lateral side portion and a sealing structure second lateral side portion, the sealing structure first lateral side portion comprising a second groove, the second groove being located radially opposite the first groove with respect to a longitudinal axis of the impeller; and a pump housing surrounding the impeller, the pump housing comprising a first pump housing portion, a second pump housing portion and a third pump housing portion, the first pump housing portion being in contact with the sealing structure first lateral side portion, the third pump housing portion being located between the first pump housing portion and the second pump housing portion, the second pump housing portion comprising a third groove, the third groove being located radially opposite the second impeller outer annular portion with respect to the longitudinal axis of the impeller, the second pump housing portion and the second impeller outer annular portion defining another sealing structure, at least the third pump housing portion and the third impeller outer annular portion defining an impeller side chamber located between the first groove, the second groove and the third groove, the first groove and the second groove being located at an axially spaced location from the third groove with respect to the longitudinal axis, the first groove, the second groove and the impeller side chamber defining at least a portion of a debris removal path, wherein the impeller is configured to drive debris along the debris removal path, the pump housing comprising a pump housing chamber surrounding a pressure side of the impeller, wherein the impeller side chamber is in fluid communication with the pressure side of the impeller via at least the third groove, the impeller side chamber being in fluid communication with an intake side of the impeller via the first groove and the second groove.

14. The waste water pump according to claim 13, wherein the second impeller outer annular portion and the third impeller outer annular portion are free of grooves.

15. The waste water pump according to claim 13, wherein the first impeller outer annular portion is located at an axially spaced location from the second impeller outer annular portion with respect to the longitudinal axis.

16. The waste water pump according to claim 13, wherein the third groove is provided between the pump housing chamber and the impeller side chamber, at least a portion of the second pump housing portion and at least a portion of the second impeller outer annular portion being arranged adjacent to the pressure side of the impeller.

17. A waste water pump comprising: an impeder comprising a first impeller outer annular portion defining a first groove, the impeller further comprising a second impeller outer annular portion and a third impeller outer annular portion, the third impeller outer annular portion being located between the first impeller outer annular portion and the second impeller outer annular portion; a sealing structure comprising a sealing structure first lateral side portion and a sealing structure second lateral side portion, the sealing structure first lateral side portion comprising a second groove, the second groove being located radially opposite the first groove with respect to a longitudinal axis of the impeller; and a pump housing surrounding the impeller, the pump housing comprising a first pump housing portion, a second pump housing portion and a third pump housing portion, the first pump housing portion being in contact with the sealing structure first lateral side portion, the third pump housing portion being located between the first pump housing portion and the second pump housing portion, the second pump housing portion comprising a third groove, the third groove being located radially opposite the second impeller outer annular portion with respect to the longitudinal axis of the impeller, the second pump housing portion and the second impeller outer annular portion defining another sealing structure, at least the third pump housing portion and the third impeller outer annular portion defining an impeller side chamber located between the first groove, the second groove and the third groove, the first groove and the second groove being located at an axially spaced location from the third groove with respect to the longitudinal axis, the first groove, the second groove and the impeller side chamber defining at least a portion of a debris removal path, wherein the impeller is configured to drive debris along the debris removal path, wherein the third groove is provided between the pump housing chamber and the impeller side chamber, at least a portion of the second pump housing portion and at least a portion of the second impeller outer annular portion being arranged adjacent to a pressure side of the impeller.

* * * * *